US007950934B2

(12) United States Patent
Sallam et al.

(10) Patent No.: US 7,950,934 B2
(45) Date of Patent: May 31, 2011

(54) SOCKET ASSEMBLY WITH SLIDING PLATE

(75) Inventors: Faisal K. Sallam, Dearborn, MI (US); Ralph Emerson Alfeche, Northville, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/576,669

(22) Filed: Oct. 9, 2009

(65) Prior Publication Data

US 2010/0130071 A1 May 27, 2010

Related U.S. Application Data

(60) Provisional application No. 61/200,065, filed on Nov. 24, 2008.

(51) Int. Cl.
*H01R 13/44* (2006.01)

(52) U.S. Cl. ..... 439/135; 220/241

(58) Field of Classification Search ..... 174/66, 174/67; 220/241, 242; 439/135, 136, 139, 439/140, 141, 142, 145
See application file for complete search history.

(56) References Cited

U.S. PATENT DOCUMENTS

| | | | | |
|---|---|---|---|---|
| 3,865,456 | A | 2/1975 | Dola | |
| 4,798,916 | A | 1/1989 | Engel et al. | |
| 4,857,004 | A | 8/1989 | Poirier | |
| 4,952,756 | A | 8/1990 | Meyers | |
| 5,107,075 | A | 4/1992 | Currier, Jr. | |
| 5,198,618 | A | 3/1993 | Shieh | |
| 5,449,860 | A | 9/1995 | Buckshaw et al. | |
| 5,563,373 | A | 10/1996 | Doroslovac | |
| 5,727,958 | A | 3/1998 | Chen | |
| 5,839,909 | A * | 11/1998 | Calderara et al. | 439/137 |
| 5,866,846 | A | 2/1999 | Huag | |
| 5,965,846 | A * | 10/1999 | Shotey et al. | 174/66 |
| 5,997,318 | A * | 12/1999 | Chou | 439/136 |
| 5,997,319 | A | 12/1999 | Wu | |
| 6,087,818 | A | 7/2000 | Hughes | |
| 6,305,956 | B1 * | 10/2001 | Deng | 439/138 |
| 6,372,987 | B1 | 4/2002 | Ha | |
| 6,545,215 | B2 | 4/2003 | Young et al. | |
| 6,596,940 | B2 * | 7/2003 | Wang | 174/67 |
| 6,637,166 | B2 | 10/2003 | Kinsey | |
| 7,094,969 | B1 | 8/2006 | In | |
| 7,098,403 | B2 | 8/2006 | Jolley | |
| 7,214,102 | B2 | 5/2007 | Chong | |
| 7,319,193 | B2 | 1/2008 | Halterman | |
| 7,331,804 | B2 | 2/2008 | Okada et al. | |
| 7,456,360 | B2 * | 11/2008 | Schmieta et al. | 174/66 |

* cited by examiner

*Primary Examiner* — Thanh-Tam T Le
(74) *Attorney, Agent, or Firm* — Brooks Kushman P.C.

(57) ABSTRACT

In at least one embodiment, a socket assembly that is positioned in a vehicle is provided. The socket assembly includes a socket plate and a socket body. The socket plate defines a first plurality of openings to enable a connection to a plurality of terminals. The socket body defines a recess therein and a second plurality of openings extend therethrough for receiving the plurality of terminals. The socket body includes at least one channel positioned on an outer periphery of the recess to receive the socket plate such that the socket plate is moveable across the recess and the first plurality of openings are capable of being aligned over the second plurality of openings. The socket body further includes at least one locking member protruding from the socket body to secure the socket plate to the socket body.

17 Claims, 3 Drawing Sheets

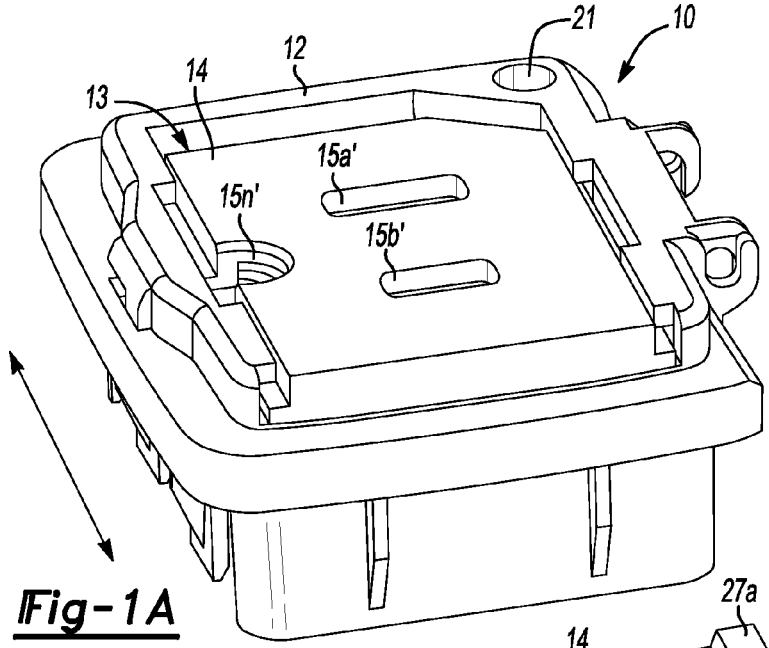
Fig-1A
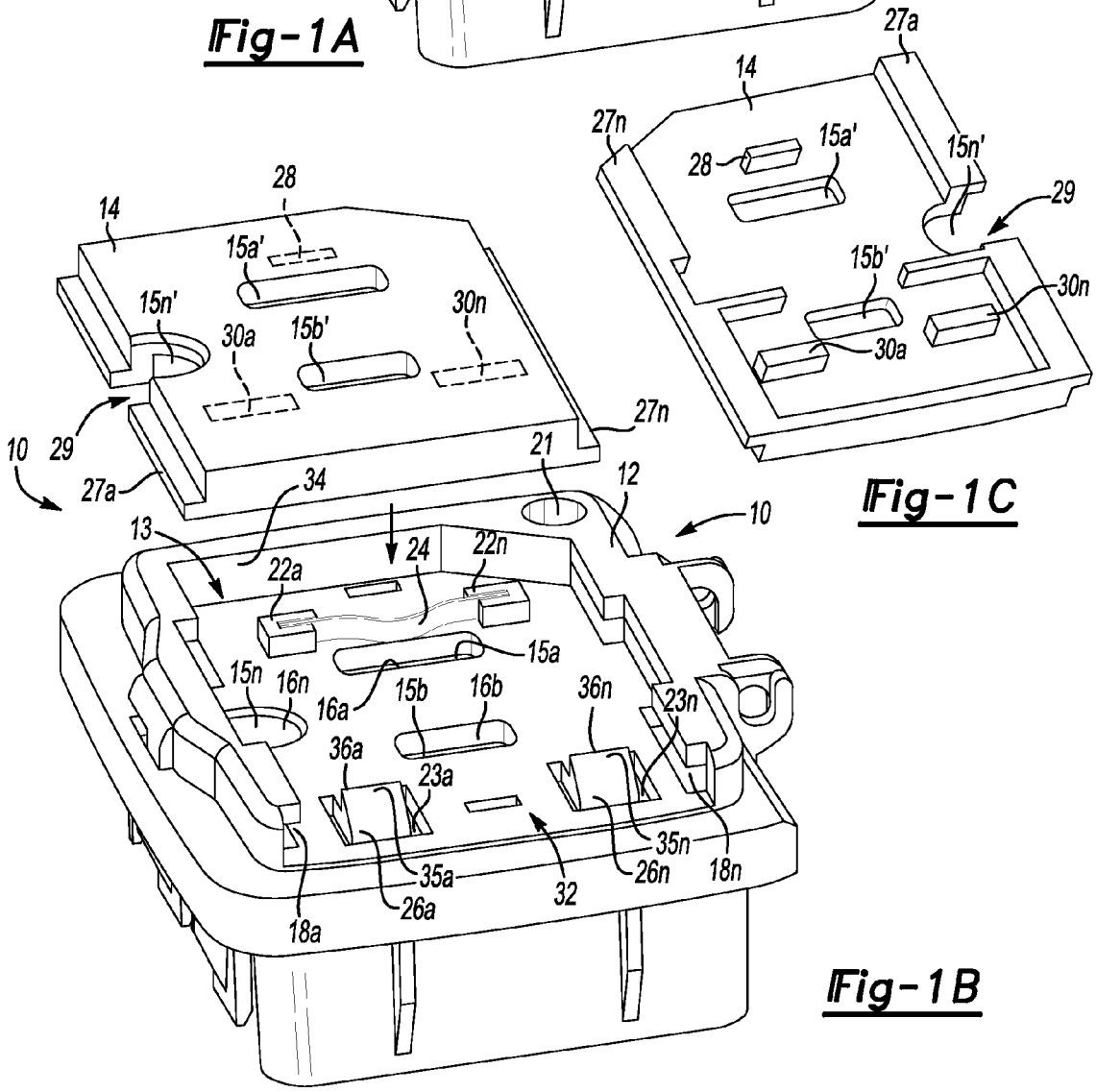
Fig-1C
Fig-1B 21
60
12
14
15a'
15n'
15b'

27a
14
15n'
27n
29
28
15a'
15b'
30
14
28
15a'
15n'
15b'
30
29
27n
60
27a
21
12
34
22n
13
24
60
22a
15a
15n
16n
16a
15b
16b
26
18n
18a
32

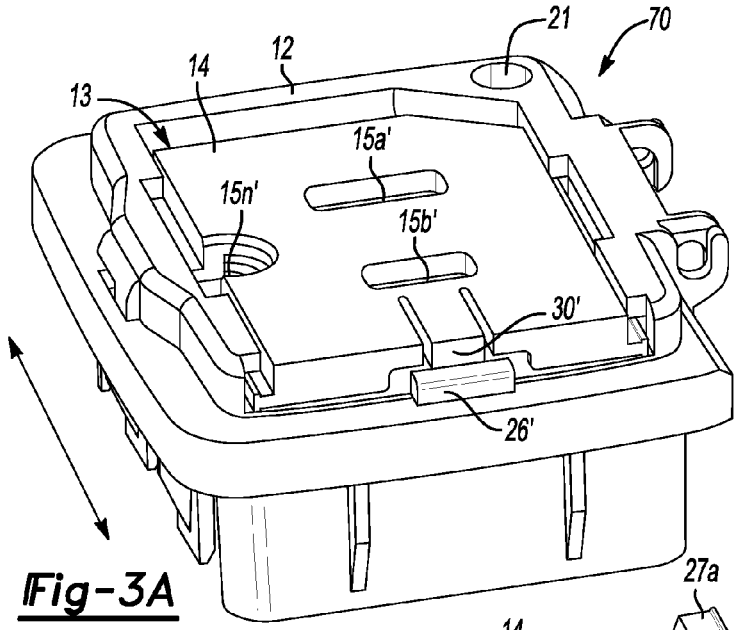
Fig-3A
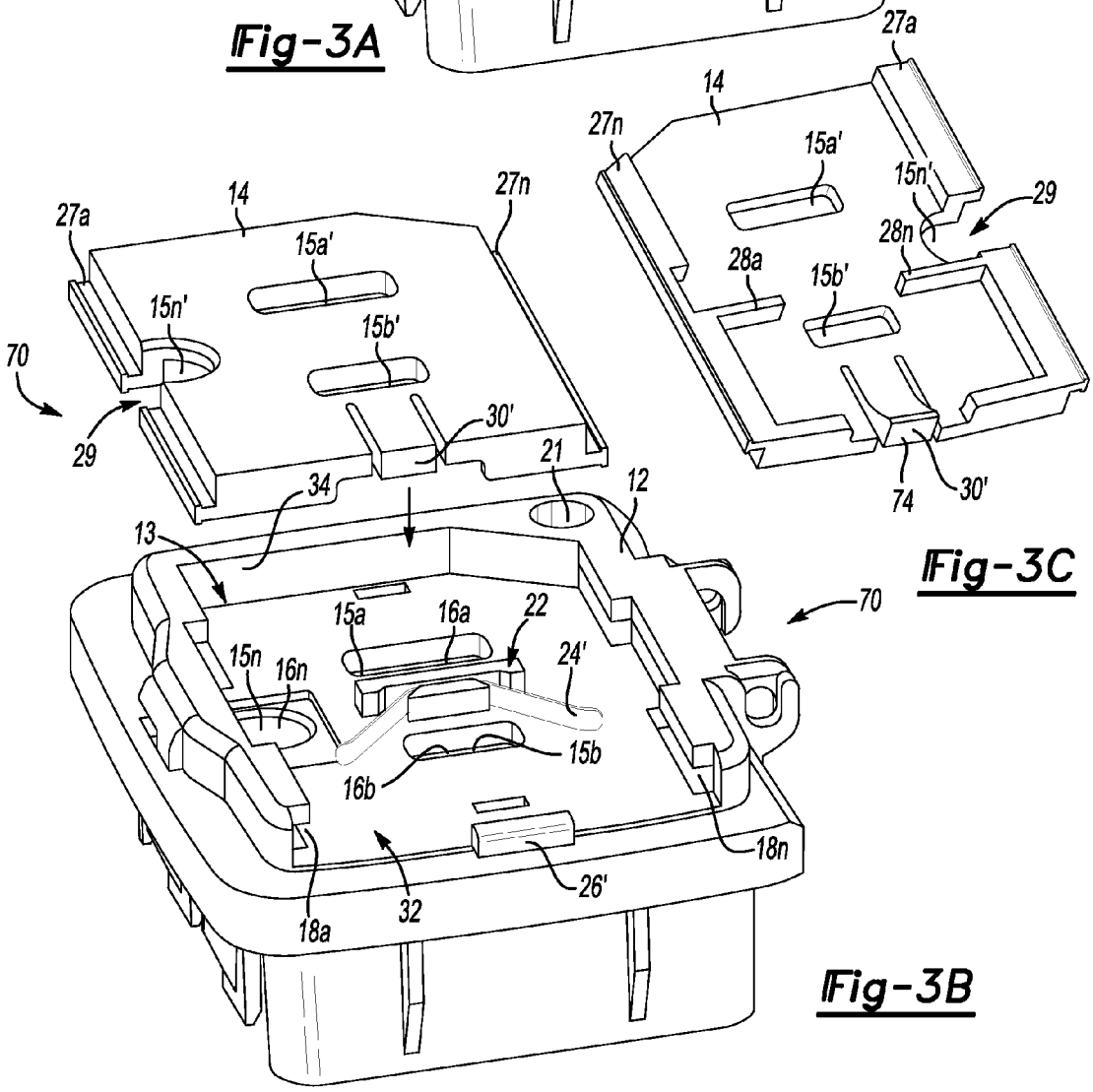
Fig-3C
Fig-3B

SOCKET ASSEMBLY WITH SLIDING PLATE

CROSS-REFERENCE TO RELATED APPLICATIONS

This application claims the benefit of U.S. provisional application Ser. No. 61/200,065 filed on Nov. 24, 2008 which is hereby incorporated by reference in its entirety.

BACKGROUND

1. Technical Field

The embodiments of the present invention generally relate to a socket assembly having a sliding plate for use in a vehicle.

2. Background Art

It is known that in order to charge or use electrical devices that are not part of a vehicle, various adapters are needed to be purchased so that such adapters can be plugged into a power outlet of the vehicle in order to use the electrical device. For example, a laptop generally uses a multi-prong connector that is coupled via a cable to an electrical outlet in a building, home or other dwelling establishment. As is known, in order to charge and/or use the laptop in a vehicle, a vehicle adapter is needed that includes a cable and a connector that is generally cylindrically shaped. The cylindrically shaped connector includes a retractable conductive pin that makes contact with a mating terminal positioned within the power outlet (e.g., cigar lighter) of the vehicle to enable power transmission between the vehicle and the laptop.

It is also known that original equipment manufacturers (OEMs) are attempting to obviate the need for vehicle occupants to have to purchase the vehicle electrical adapter as described above. For example, OEMs are implementing a female prong connector within the vehicle that includes a plurality of female terminals that is capable of receiving corresponding male terminals from an electrical device. The vehicle may include a standalone inverter module for converting the DC power into AC power. The female prong connector is similar to that invoked when connecting an electrical device to an electrical wall outlet in a building or other suitable establishment. OEMs are consistently on guard for the need to provide a safe connection for users that may come into contact with the female prong connector or other componentry that is utilized to provide for DC to AC conversion.

One conventional implementation for providing a safe connection is to provide a socket within the vehicle that includes a rotary cover. The rotary cover has cutouts formed therein that is capable of being aligned with female terminals positioned within the socket. The female terminals are operably coupled to the vehicle's battery source and ground. In a non-use state, the rotary cover is biased via springs so that the cutouts are misaligned with the female terminals to prevent a user from inserting male prongs that belong to the electrical device with the female terminals. Such a condition is employed to prevent access to the female terminals for young children. To connect the prongs members belonging to the portable electric device so that the electrical device receives power from the vehicle, the occupant is required to rotate the cover so that the cutouts in the cover are aligned over the female terminals of the socket. The occupant is to hold the cover so that the cutouts are aligned with the female terminals while inserting the male prongs of the portable electrical device therethrough. While the implementation of the rotary cover is effective, the design can be complex and may increase the overall cost of the socket.

SUMMARY

In at least one embodiment, a socket assembly that is positioned in a vehicle is provided. The socket assembly includes a socket plate and a socket body. The socket plate defines a first plurality of openings to enable a connection to a plurality of terminals. The socket body defines a recess therein and a second plurality of openings extend therethrough for receiving the plurality of terminals. The socket body includes at least one channel positioned on an outer periphery of the recess to receive the socket plate such that the socket plate is moveable across the recess and the first plurality of openings are capable of being aligned over the second plurality of openings. The socket body further includes at least one locking member protruding from the socket body to secure the socket plate to the socket body.

BRIEF DESCRIPTION OF THE DRAWINGS

The embodiments of the present invention are pointed out with particularity in the appended claims. However, other features of the various embodiments will become more apparent and will be best understood by referring to the following detailed description in conjunction with the accompany drawings in which:

FIGS. 1A-1B generally depict a socket assembly in accordance to one embodiment of the present invention;

FIG. 1C generally depicts an underside of a socket plate for the socket assembly;

FIGS. 3A-3B generally depict the socket assembly in accordance to another embodiment of the present invention; and FIG. 3C generally depicts an underside of a socket plate for the socket assembly illustrated in FIGS. 3A-3B.

DETAILED DESCRIPTION

Figures 2A, 2B, 2C:
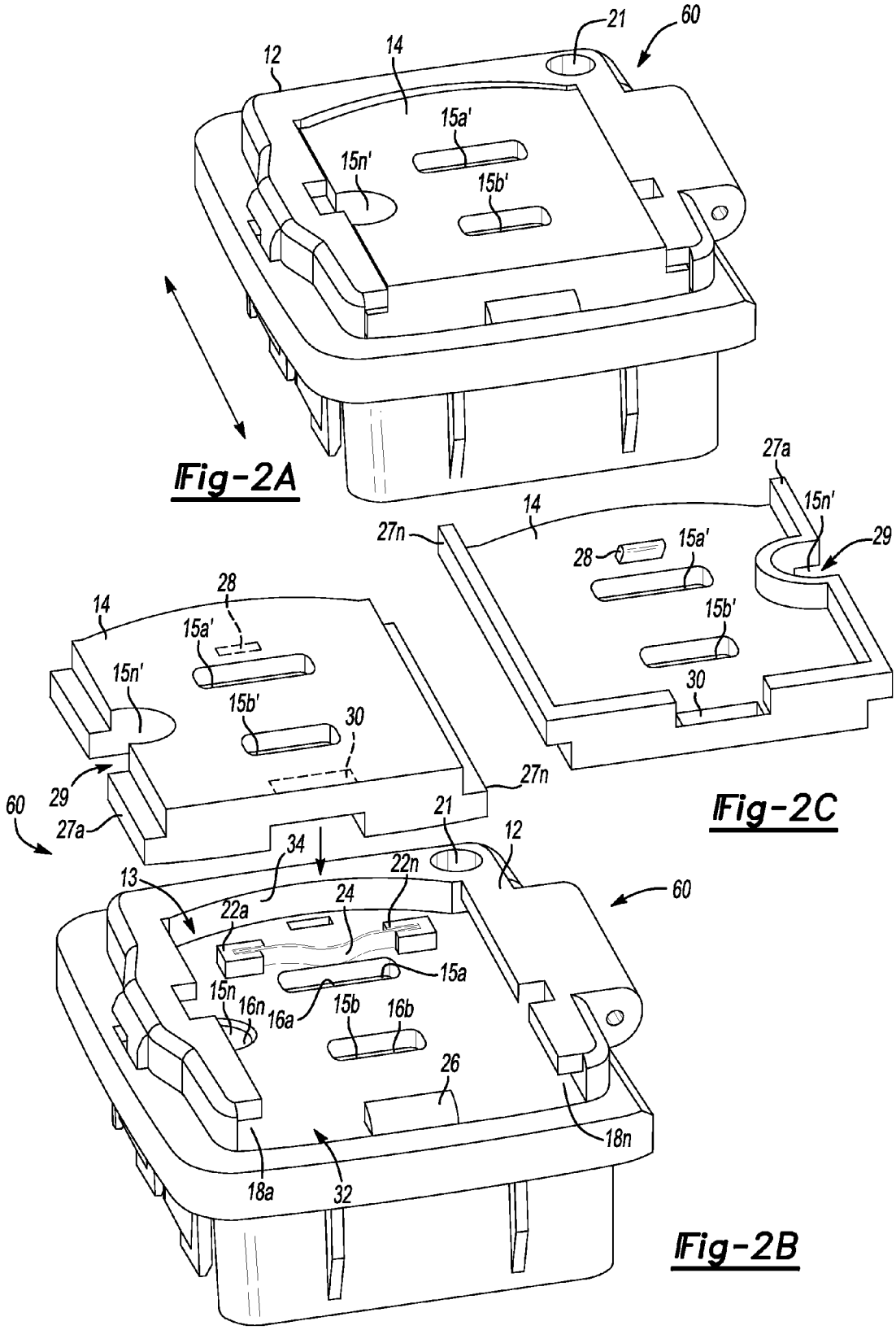
FIGS. 2A-2B generally depict the sliding socket assembly in accordance to another embodiment of the present invention.
FIG. 2C generally depicts an underside of a socket plate for the socket assembly illustrated in FIG. 2B.

Detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the one or more embodiments of the present invention.

FIGS. 1A-1B depict a socket assembly 10 in accordance to one embodiment of the present invention. The socket assembly 10 includes a socket body 12 and a socket plate 14. The socket body 10 defines a recess 13 on a top portion thereof for receiving the socket plate 14. The socket body 12 generally defines openings 15*a*-15*n* that extend through an interior section of the socket body 12 for receiving various female terminals 16*a*-16*n*. The female terminals 16*a*-16*n* are operably coupled to circuitry in the vehicle to enable the transmission of AC power. The female terminals 16*a*-16*n* may correspond to a hot, neutral or optional ground circuit. While three terminals are depicted, it is contemplated that the socket assembly 10 may be implemented with two terminals.

The socket assembly 10 may be positioned in an instrument panel of the vehicle or other suitable location therein. The socket assembly 10 enables the delivery of electrical power from the vehicle to a portable electronic device. The female terminals 16*a*-16*n* mate with male terminals that belong to the portable electronic device. The portable device may include, but not limited to, a laptop, a vacuum cleaner, a cell phone or any other device that is capable of being positioned within the vehicle that may need electrical power to operate.

The socket body 12 defines a first receiving channel 18 and a second receiving channel 20 that are spaced apart from one another to receive the socket plate 14. Spring locking channels 22*a*-22*n* are integrally formed to the socket body 12 and disposed within the recess 13. A spring 24 is coupled at both ends thereof to the locking channels 22*a*-22*n*. The spring 24 may be a leaf spring or other suitable spring. The spring 24 may remain coupled in a pre-load state while positioned within the locking channels 22*a*-22*n*. Each locking channel 22*a*-22*n* includes an opening to establish an interference fit with the spring 24 such that the spring 24 is fixed to the socket body 12. First and second resilient locking fingers 26*a*-26*n* are integrally formed to the socket body 12 and disposed within the recess 13. The socket body 12 defines a first opening 23*a* and a second opening 23*n* for receiving the resilient locking fingers 26*a*-26*n*, respectively. The socket 10 further defines an opening 21 for receiving a light generating device such as, but not limited to, a bulb or light emitting device (LED).

The socket plate 14 defines openings 15*a*'-15*n*' that are to align with the openings 15*a*-15*n* of the socket body 12. The socket plate 14 further includes projecting sections 27*a*-27*n* that are spaced apart and extend on an outer periphery of the socket plate 14 (see FIG. 1C for underside view of socket plate 14). The projecting section 27*a* includes a notched portion 29 which also forms a portion of the opening 15*n*' to enable a male terminal to pass therethrough when the socket plate 14 is coupled to the body 12. The socket plate 14 includes an integrally formed blocking member 28 that projects from an underside of the socket plate 14. The socket plate 14 further includes first and second stop members 30*a*-30*n* that also project from the underside of the socket plate 14.

To couple the socket plate 14 to the socket body 12, the user inserts the socket plate 14 into a front section 32 of the recess 13 such that the projecting sections 27*a*-27*n* are aligned into the first and the second receiving channels 18*a*-18*n*, respectively. When the projecting sections 27*a*-27*n* are inserted into and aligned with the first and the second receiving channels 18*a*-18*n*, the blocking member 28 of the socket plate 14 passes between the first resilient locking member 26*a* and the second resilient locking member 26*n*. As the socket plate 14 continues to move into the recess 13 and toward the spring 24, the stop members 30*a*-30*n* contact the first and the second resilient locking members 26*a* and 26*n*, respectively. The contact causes the locking members 26*a*-26*n* to deflect downward into the first and the second openings 23*a*-23*n*, respectively.

As illustrated, the locking members 26*a*-26*n* comprise a ramp shaped surface 35*a*-35*n*, respectively, which enables the stop members 30*a*-30*n* to pass thereover for allowing the socket plate 14 to move toward a rear end 34 of the recess 13. The locking members 26*a*-26*n* comprise a flat surface portion 36*a*-36*n*, respectively, positioned on a side opposite to the ramp shaped surfaces 35*a*-35*n*, respectively. As the stop member 30*a*-30*n* moves past the locking members 26*a*-26*n*, the blocking member 28 compresses the spring 24, and the locking members 26*a*-26*n* deflect upward from the first and the second openings 23*a*-23*n* behind the stop members 30*a*-30*n* (e.g., behind the flat surface portions 36*a*-36*n*) thereby fastening the socket plate 14 to the socket body 12.

As shown, the spring 24 is biased (or pre-loaded) toward the blocking member 28 such that the stop members 30*a*-30*n* are pushed back and abut the flat surface portions 36*a*-36*n* after the socket plate 14 is fastened to the socket body 12 (i.e., the user is not applying a force against the socket plate 14). In this natural state, the openings 15*a*'-15*n*' of the socket plate 14 are not aligned with the openings 15*a*-15*n* of the socket body 12. As such, an electrical connection cannot be made with the female terminals 16*a*-16*n* since the openings 15*a*-15*n* are covered by the surface of the socket plate 14.

To establish an electrical connection, the user must apply a force against the socket plate 14 such that the blocking member 28 moves the spring 24 toward the rear end 34. Once the socket plate 14 comes into contact with the rear end 34 (or generally proximate to the rear end 34), the openings 15*a*'-15*n*' of the socket plate 14 are aligned with the openings 15*a*-15*n* of the socket body. In this aligned state, the user can insert male terminals from the electronic device into the female terminals 16*a*-16*n* to establish an electrical connection. The recess 13 of the socket body 12 is arranged at a predetermined length to enable the socket plate 14 to be moveable therein after the socket plate 14 is fixed to the socket body 12.

FIGS. 2A-2B depict a socket assembly 60 in accordance to one embodiment of the present invention. The socket assembly 60 includes a single locking member 26 being implemented within the recess 13 of the socket body 12 and a single stop member 30 being implemented on the socket plate 14. The single locking member 26 is centrally positioned within the recess 13. The single locking member 26, the blocking member 28, and the single stop member 30 may each have a radius formed on an outer portion thereof.

To insert the socket plate 14 to the socket body 12, the user inserts the projecting sections 27*a*-27*n* into the receiving channels 18*a*-18*n* and applies a force such that the radius of the blocking member 28 and the stop member 30 passes over the radius of the blocking member 26. After the blocking member 28 and the stop member 30 passes over through the locking member 26, the socket plate 14 is fixed within the recess 13 of the socket body 12. In a natural state, the spring 24 biases the socket plate 14 such that the rear end portion of the stop member 30 abuts the locking member 26 (e.g., spring 24 contacts a front portion of the blocking member 28). For example, the spring 24 is pre-loaded to apply a force against the blocking member 28 so that the socket plate 14 covers the openings 15*a*-15*n*. In the natural state, the socket plate 14 blocks the openings 15*a*-15*n*. To enable a connection between the terminals 16*a*-16*n* and the terminals of the portable electronic device, the user shifts the socket plate 14 thereby moving the spring 24 toward the rear end 34 of the socket body 12 with the blocking member 28 such that the openings 15*a*-15*n* align with the openings of the female terminals 16*a*-16*n*. The recess 13 of the socket body 12 is arranged at a predetermined length to enable the socket plate 14 to be moveable therein after the socket plate 14 is fixed to the socket body 12.

FIGS. 3A-3B depict a socket assembly 70 in accordance to one embodiment of the present invention. The socket assembly 70 includes a single locking channel 22 integrally formed on a top portion of the socket body 12 (or within the recess 13). The single locking channel 22 includes a first wall member 72*a* and a second wall member 72*n*. A spring 24' is fixed between the first and the second wall members 72*a*-72*n*. The spring 24' may be implemented as a leaf spring or other suitable spring. The spring 24' includes a first end, a second end, and a central portion disposed between the first and the second ends. The first and the second ends of the spring 24 are free to engage the socket plate 14. A single locking member 26' is integrally formed on the top portion of the socket body 12 (or within the recess 13). The socket plate 14 includes first and second blocking members 28*a*-28*n* and a resilient stop member 30' (see FIG. 3C for underside view of the socket plate 14).

To insert the socket plate 14 to the socket body, the user inserts the projecting sections 27*a*-27*n* into the receiving channels 18*a*-18*n*, respectively, and applies a force such that the first and the second blocking members 28*a*-28*n* are passed beyond the locking member 26' toward the rear end 34. The first and the second blocking members 28*a*-28*n* define an opening therebetween to avoid being blocked with the locking member 26' when the projecting sections 27*a*-27*n* are inserted into the receiving channels 18*a*-18*n*. After the first and the second blocking member 28*a*-28*n* pass through the locking member 26', the stop member 30' deflects upwardly and passes over the locking member 26'. The first and the second blocking member 28*a*-28*n* compress the spring 24' until the stop member 30' completely passes over the locking member 26'. The spring 24' is configured to deflect back thereby moving the first and the second blocking members 28*a*-28*n* back toward the locking member 26'.

A flat portion 74 of the stop member 30' abuts the locking member 26' to lock the socket plate 14 into the socket body 12. In a natural state, the flat portion 74 of the stop member 30' abuts the locking member 26', and the socket plate 14 covers the openings 15*a*-15*n* so that an electrical connection cannot be made with the female terminals 16*a*-16*n*. For example, the spring 24' is pre-loaded to apply a force against the blocking member 28 so that the socket plate 14 covers the openings 15*a*-15*n*. To enable a connection between the terminals 16*a*-16*n* and the terminals of the portable electronic device, the user shifts the socket plate 14 thereby moving the first and the second ends of the spring 24' toward the rear end 34 such that the openings 15*a*-15*n* align with the openings of the female terminals 16*a*-16*n*. The recess 13 of the socket body 12 is arranged at a predetermined length to enable the socket plate 14 to be moveable therein after the socket plate 14 is fixed to the socket body 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A socket assembly positioned in a vehicle to establish a connection with a plurality of terminals, the assembly comprising:
   - a socket plate defining a first plurality of openings and including a stop member;
   - a socket body defining a recess in a top portion thereof and a second plurality of openings extending therethrough for receiving the plurality of terminals, the socket body including:
     - a spring disposed within the recess;
     - at least one receiving channel positioned in the recess to receive the socket plate such that the socket plate exerts a force against the spring to move across the recess for the first plurality of openings to be positioned over the second plurality of openings; and
     - at least one locking member protruding from the socket body to receive the stop member.

2. The socket assembly of claim 1 wherein the socket body includes at least one locking channel that protrudes outwardly therefrom for receiving the spring.

3. The socket assembly of claim 2 wherein the spring includes a first end, a second end, and a central portion positioned between the first and the second end, the central portion being coupled to the at least one locking channel to fix the spring to the socket body.

4. The socket assembly of claim 3 wherein the socket plate includes a first blocking member for engaging the first end and a second blocking member for engaging the second end.

5. The socket assembly of claim 1 wherein the socket plate is configured to move in a direction that is generally perpendicular to the second plurality of openings.

6. The socket assembly of claim 1 wherein the spring is a leaf spring.

7. A socket assembly positioned in a vehicle to establish a connection with a plurality of terminals, the assembly comprising:
   - a socket plate defining a first plurality of openings and including a stop member;
   - a socket body defining a recess in a top portion thereof and a second plurality of openings extending therethrough for receiving the plurality of terminals, the socket body including:
     - a spring disposed within the recess;
     - at least one receiving channel positioned in the recess to receive the socket plate such that the socket plate compresses the spring to move across the recess for the first plurality of openings to be positioned over the second plurality of openings; and
     - at least one locking member protruding from the socket body for receiving the stop member.

8. The socket assembly of claim 7 wherein the socket body includes at least one locking channel that protrudes outwardly therefrom for receiving the spring.

9. The socket assembly of claim 8 wherein the spring includes a first end, a second end, and a central portion positioned between the first and the second end, the central portion being coupled to the at least one locking channel to fix the spring to the socket body.

10. The socket assembly of claim 9 wherein the socket plate includes a first blocking member for engaging the first end and a second blocking member for engaging the second end.

11. The socket assembly of claim 7 wherein the socket plate is configured to move in a direction that is generally perpendicular to the second plurality of openings.

12. A socket assembly positioned in a vehicle to establish a connection with a plurality of terminals, the assembly comprising:
   - a socket plate defining a first plurality of openings and including a stop member;
   - a socket body defining a recess in a top portion thereof and a second plurality of openings extending therethrough for receiving the plurality of terminals, the socket body including:
     - a spring being disposed within the recess;
     - at least one receiving channel positioned in the recess to receive the socket plate such that the socket plate cooperates with the spring to move across the recess such that the first plurality of openings are positioned over the second plurality of openings; and
     - at least one locking member protruding from the socket body to receive the stop member.

13. The socket assembly of claim 12 wherein the socket body includes at least one locking channel that protrudes outwardly therefrom for receiving the spring.

14. The socket assembly of claim 13 wherein the spring includes a first end, a second end, and a central portion positioned between the first and the second end, the central portion being coupled to the at least one locking channel to fix the spring to the socket body.

15. The socket assembly of claim 14 wherein the socket plate includes a first blocking member for engaging the first end and a second blocking member for engaging the second end.

16. The socket assembly of claim 12 wherein the socket plate is configured to move in a direction that is generally perpendicular to the second plurality of openings.

17. The socket assembly of claim 12 wherein the spring is a leaf spring.

* * * * *